United States Patent [19]

Selander et al.

[11] 4,221,630

[45] Sep. 9, 1980

[54] WET METHOD OF PREPARING FIBERBOARD PRODUCTS IN A SUBSTANTIALLY CLOSED AND BALANCED WHITE WATER SYSTEM

[75] Inventors: Stig D. Selander, Fredrikshovsq. 5, S-111 22, Stockholm, Sweden; Karl N. Cederquist, Stockholm, Sweden

[73] Assignee: Stig Selander, Stockholm, Sweden

[21] Appl. No.: 898,385

[22] Filed: Apr. 20, 1978

[30] Foreign Application Priority Data

Apr. 25, 1977 [SE] Sweden ..... 7704737

[51] Int. Cl.[2] ..... D21C 9/18

[52] U.S. Cl. ..... 162/13; 162/23; 162/47; 162/132; 162/190; 162/225

[58] Field of Search ..... 162/190, 123, 133, 264, 162/300, 201, 13, 132, 23, 47, 225

[56] References Cited

U.S. PATENT DOCUMENTS

| | | | |
|---|---|---|---|
| 3,821,073 | 6/1974 | Ericksson | 162/264 |
| 4,012,279 | 3/1977 | Selander et al. | 162/190 |

FOREIGN PATENT DOCUMENTS

| | | | |
|---|---|---|---|
| 23245 | of 1904 | United Kingdom | 162/133 |

*Primary Examiner*—S. Leon Bashore
*Assistant Examiner*—Peter Chin
*Attorney, Agent, or Firm*—Eric Y. Munson

[57] ABSTRACT

A method of making fiberboard using a substantially closed white water system. One or more layers of separately prepared surface pulp is applied to a layer of base pulp at the wet sheet forming stage. Lignocellulose chips in a pressure-sealed defibrating zone under generation of steam. The steam is separated at the discharge end of the defibrating zone under atmospheric pressure. The atmospheric steam is utilized to presteam the raw chips. The presteamed chips are thereafter dewatered to a moisture content coordinated to the energy demand of the defibrating treatment and the desired generation of steam prior to entering the defibrating zone. The water removed at the dewatering stage is collected for use in preparing the surface layer pulp suspension. A small portion of the base pulp to be used for the surface layer pulp is diverted to a refiner and diluted with water. The major portion of the base pulp is diluted with white water drained off and recycled from the base layer wet sheet forming stage to form a base layer suspension, which suspension is then transported by the white water to the wet sheet forming stage, where the white water and recycled to the base layer suspension stage to form a new base layer suspension. The diverted portion of the base pulp is further diluted with white water recycled from the surface layer forming stage to form a surface layer suspension.

A portion of the white water recycled from the wet sheet forming stage to the base layer suspension stage is heated by a portion of the steam separated at the discharge end of the defibrating zone to drive off surplus white water to maintain a constant volume of white water.

5 Claims, 1 Drawing Figure

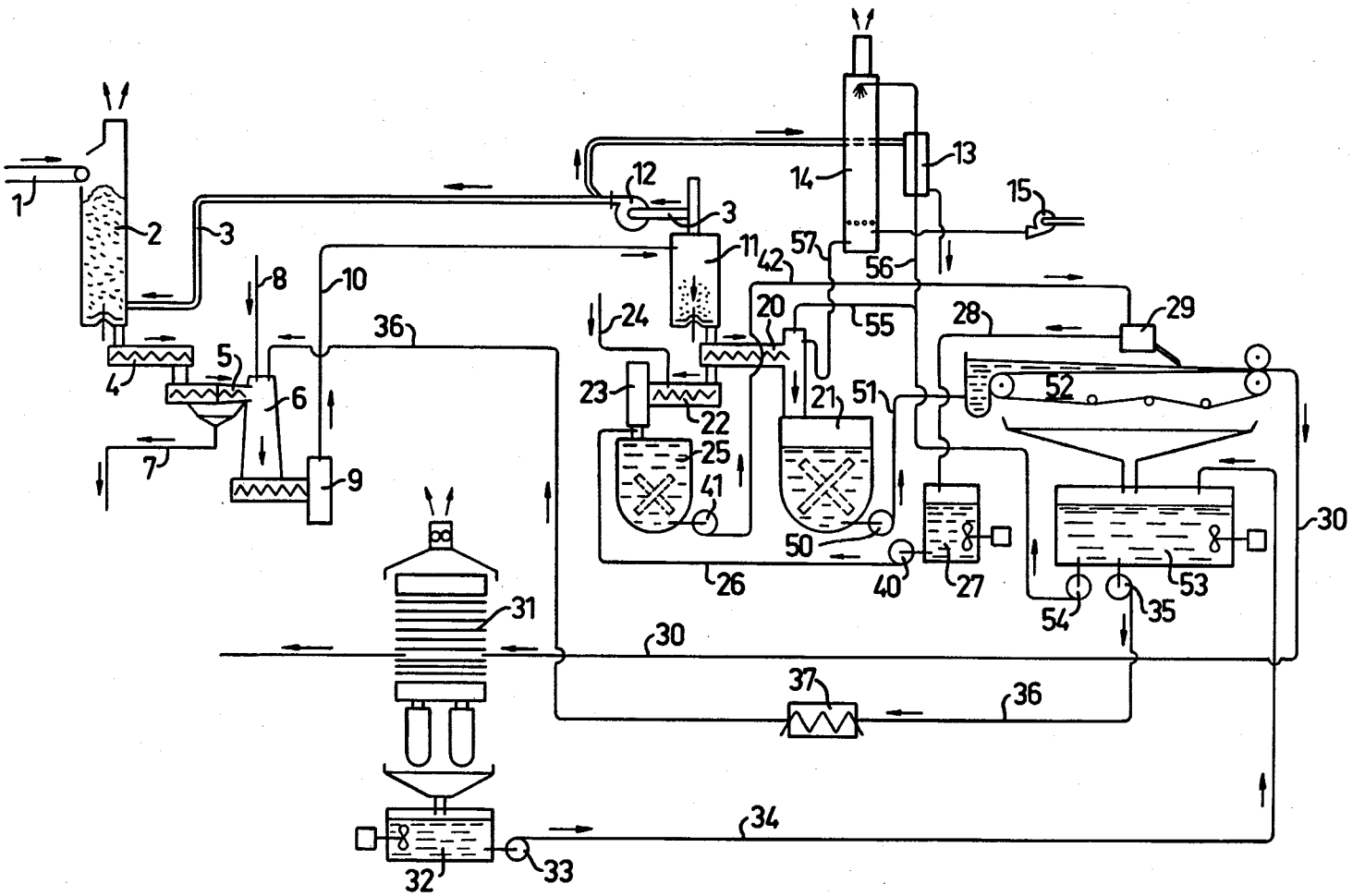
1
2
3
4
5
6
7
8
9
10
11
12
13
14
15
20
21
22
23
24
25
26
27
28
29
30
31
32
33
34
35
36
37
40
41
42
50
51
52
53
54
55
56
57

WET METHOD OF PREPARING FIBERBOARD PRODUCTS IN A SUBSTANTIALLY CLOSED AND BALANCED WHITE WATER SYSTEM

BACKGROUND OF THE INVENTION

In making fiberboard according to the wet method from lignocellulose-containing fiber material which has been defibrated in a pressurized, saturated steam atmosphere at temperatures of 100° C. and above, e.g. between 110° C. and 200° C., a certain fraction of the fibrous material is dissolved through hydrolysis of the hemicellulose components among other substances. Depending on the chemical nature of the cellulose-containing material and on the temperature and acidity prevailing during defibration, the amount of dissolved substances may vary between 4% and 12% of the solids in the defibrated material.

In most cases the fibrous material consists of hardwoods and softwoods, but it may also consist to some extent of bagasse, straw etc., which are usually chipped or chopped before defibering. Hereafter, all usable lignocellulose-containing fiber materials will be referred to by the collective term "wood" or, when in comminuted form, by the term "chips".

The amount of the dissolved substances that escapes with the process water and contaminates the environment depends on how effectively the white-water system is closed. If the latter is completely closed, no dissolved substance at all will escape, but all the material will be retained in the finished board. Not only does this afford perfect environmental protection at reasonable cost, but the yield of the fiberboard approaches 100% by weight.

When a fiberboard plant operates with a completely or almost completely closed white-water system, resulting in a high concentration of soluble substances in the white water, an improvement in the mechanical strength and the swelling parameters of the fiberboard is usually obtained, but other qualities such as color, water absorption, and in some cases surface impermeability may be somewhat inferior.

The surface properties of the fiberboard, such as brightness, impermeability and hardness, can be improved and the quality of the board enhanced by applying surface pulp stock of relatively high freeness and slurried in clean or relatively clean water. The concommitant disadvantage, however, is that the forming machine is thereby supplied with extra water that considerably increases the quantity of white water discharge from the machine, something which cannot be allowed in completely or substantially closed white-water systems.

SUMMARY OF THE INVENTION

The present invention provides a method of applying one or more layers of surface stock to a web of base pulp produced in a closed or substantially closed white-water system without any increase in the volume of white water and without any appreciable effect on the energy required for the production of the fiberboard. The method may also be used with a white-water system that is only partially closed if it is desired to prevent any increase in the amount of waste of or dilution in process water.

This invention is an improvement of the inventions described in Swedish Pat. Nos. 355.617, 7312580-9 (corresponding to U.S. Pat. No. RE 29770) and 7317565-5 (corresponding to U.S. Pat. No. 4,012,279) for manufacturing fiberboard in a closed white-water system, which after several years of practical operation has in many cases proved be a satisfactory solution of a topical environmental problem.

In summary, the method of manufacture as described in the above Swedish patent and U.S. patents is based on the practice of presteaming the raw chips to a temperature ranging between 90° C. and 100° C. by means pressurized of steam released as the defibered pulp is discharged to atmospheric pressure. The steamed chips are then, while still hot, dewatered by mechanical compression as disclosed by the aforementioned patents as they are fed into the preheater of the defibering system, where the chips are heated to the defibering temperature by the supply of high-pressure steam, whereafter they are introduced into the defibering zone. In the defibering zone, heat is evolved by the defibering energy, and steam is generated in sufficient quantity from the water that is present. The defibered pulp, water and steam are then discharged to a cyclone operating at a pressure equal to or slightly above atmospheric pressure and the liberated steam is separated from the pulp. The steam leaving the cyclone is used for pre-steaming the chips, and the steam liberated pulp is diluted with white water and formed into sheets that are hot-pressed or dried into the finished product.

If to the web of base pulp there is applied a surface stock slurried with clean or comparatively clean water is applied to the web of base pulp as has been customary hitherto, the volume of white water will be increased, as mentioned above, and the surplus water must be diverted to a receiver or eliminated by other means. By means of the present invention it has proved to be possible to prevent all surplus of white water provided certain definite conditions are met during production. In any case, the surplus can be limited so that the surplus water added to the white water which is required for applying the surface stock to the layer of base pulp can be driven off or evaporated by means of the surplus steam remaining after the portion of steam required for the pre-steaming of the chips has been separated from the steam discharged with the defibrated pulp.

The conditions and requirements for achieving this result are presented in the following numbered paragraphs:

(1) Enough energy should be supplied in the defibering stage to render further refining unnecessary or enable it to be effected with a minimum of electrical power. Thus at least 150–175 kWh per ton of pulp (solids) can be applied to the defibering stage. This will ensure that enough steam is liberated, as the pulp is discharged to atmospheric pressure, for pre-steaming the chips and for evaporating the requisite amount of water from the white water to keep the volume of the latter constant.

(2) The consistency of the pulp obtained in the cyclone should be between 55% and 70%. In order to maintain this consistency, it is advisable to supply a comparatively great amount of electrical power in the defibering stage. This results in more water evaporating during defibration and in the pulp having a higher consistency.

(3) Further, the steam consumption in the steaming of the chips must be kept low by concentrating the raw chips to a high dry content, over 45% and preferably between 50% and 55%. The importance of this may be illustrated by the following figures: if 1 ton (solids) of chips is steamed to approx. 90° C., the steam consumption at 45% dry content is 281 kg; at 50% dry content, 244 kg; at 53% dry content, 225 kg; and at 55% dry content, 214 kg of steam. The further advantage is also obtained that the quantity of water and condensates extracted from the chips as the latter are fed into the preheater of the defibering stage decreases as the dry content of the chips before steaming increases. Thus, for example, from 1 ton of chips (solids) at 45% dry content, 647 kg of water is obtained; a 50% dry content, 408 kg of water; at 53% dry content, 276 kg of water; and at 55% dry content, 194 kg of water, which must be in some way eliminated, as by using it for diluting the surface stock, with or without preliminary treatment.

(4) The dewatering of the raw chips before steaming is of great importance in cases where the chips are processed in a chips washer before steaming, as they may then contain considerable amounts of adsorbed free water. The chips may for example be dewatered by conventional mechanical pressing, centrifugation, or by drying or evaporation of water by means of hot gas.

(5) To make it easier to achieve the high consistency, 60% to 70%, required in the base pulp discharged to the cyclone, the pre-steamed hot chips must be dewatered to a dry content of at least around 50% and preferably higher, between 55% and 65%, as they are fed to the preheater of the defibering stage.

The roller pressure generally extracts so much white water from the wet sheets entering the hot press that its dry content is around 55% as drying begins. The base pulp produced must at least have this concentration to maintain the balance of the white-water system. A higher concentration has the advantage of permitting the addition of water to the white-water system, thus reducing in a corresponding degree the amount of water that has to be evaporated to balance the water entering the system in the application of the surface stock. To illustrate by means of figures the effect of various factors on the possibility of preventing an increase in the volume of white water in the application of surface stock when using a closed white-water system, on the assumption that the power consumption is kept within normal limits, i.e. 150–175 kWh per ton of stock, it may be mentioned that if chips with a dry content of 50% are steamed to 90° C. and dewatered to 55% dry content at the infeed to the preheater of the defibering stage, the preheater must be supplied with approximately 200 kg high-pressure steam per ton of chips to attain a defibering temperature of 170° C. With electrical energy inputs of 150 kWh and 175 kWh per ton of pulp, the discharged pulp after steam separation will then have consistencies of 60.1% and 61.5% respectively, and the quantities of steam discharged will be 369 kg and 400 kg respectively, of which 125 kg and 156 kg respectively can be used for evaporating water after withdrawing 244 kg for presteaming the chips, as mentioned herein.

Surface pulp stock may obviously be produced from various types of pulp, e.g. defibrator pulp, groundwood pulp, refiner pulp, waste-paper pulp of varous origins, etc., depending on the required standard of the board surface. It is convenient, however, to take as a starting-point the base pulp obtained from the cyclone, and to divert an appropriate quantity thereof to be refined to the desired freeness in a separate step after dilution with clean or almost clean water. The quantity of diverted base pulp, having a concentration of, for example, 60% or more, is diluted with water until its concentration is equal or nearly equal to that of the layer of surface stock appied to the base pulp, which should be approximately 10% or more, e.g. between 10% and 25%. After dilution, the surface pulp stock is refined to a suitable freeness and diluted by recirculating the water extracted in the forming of the surface stock into the surface layer applied to the web of base pulp. If, for example, the surface layer on 3.2 mm fiberboard has a mass of 300 g/m$^2$, this is equivalent to approx. 94 kg of surface layer per ton of fiberboard. If this surface stock is produced from a base pulp having consistency of 61.5% and is applied to the web of base pulp in the form of a layer containing 15% solids, then 473 kg of water is added before or during the refining of the surface stock, and if in the form of a layer containing 20% solids, 317 kg of water is added.

In the manufacture of fiberboard from base pulp only, using base pulp having a consistency of 61.5% and with 55% solids in the pressed fiberboard, 184 kg of water per ton of stock can be added to the white water in a closed white-water system without disturbing the water balance. If, in the case in point, 300 gr/m$^2$ surface stock having a concentration of 15% solids is applied as a surface layer, a surplus of approx. 289 kg of water is obtained in the white-water system, taking into account the 184 kg which as noted above may be added to the white water in the manufacture of fiberboard from base pulp only, and if a surface layer having a solids content of 20%, a surplus of approx. 133 kg is obtained. These surplus amounts of water must be driven off from the white water in order to maintain the volume of white water constant. In reality, the amounts will be somewhat less, as the surface layer will contain approx. 55% solids in the hot press at the start of the drying period. As mentioned herein, there is 156 kg of steam at 100° C. available for use for driving off water when base pulp is produced with a consistency of 61.5% and with a power consumption of 175 kWh per ton of pulp, from which it will appear that the consistency of the surface stock layer must be somewhat over 15% in order to avoid addition of extra steam for driving off water.

In order to improve the properties of the surface layer, such as its hardness, gloss and brightness, synthetic resins such as phenol and carbamide resins, natural resins, and bleaches may be added to the surface stock, either during the preparation thereof or by spraying them directly onto the surface stock layer after application.

If the base pulp is produced with a consistency of 65–66%, as for example by dewatering the chips to a dry content of 53% before pre-steaming and by dewatering the steamed chips to 58% dry content as they are fed to the defibering stage, a surplus of steam is obtained upon application of a surface stock layer of 20% consistency, both when using a defibering power of 150 kWh/ton and when using a defibering power of 175 kWh/ton of pulp. If a surface stock layer is applied having a consistency of 15% using a defibration energy of 175 kWh/tone of pulp, there is enough steam to keep the white-water system in balance, while if a defibration energy of 150 kWh is used, a small quantity of extra steam, 15–20 kg per ton of pulp, must be supplied. As the consistency of the surface stock layer decreases the volume of water entering the white-water system increases rapidly, so that with a consistency of 10% at least 200 kg of extra steam per ton of pulp must be added to evaporate the water. In certain cases this amount of extra steam will be available, as a result of more steam being fed to the defibration step than indicated above, as for example to ensure trouble-free discharge of the defibered pulp.

BRIEF DESCRIPTION OF THE DRAWING

The single FIGURE shows by way of example of flow diagram for making fiberboard according to the invention.

DETAILED DESCRIPTION OF A PREFERRED EMBODIMENT

Although the method can be applied in partially closed white-water systems, an example is presented below, with reference to the FIGURE, of the application of the method in the case of a closed white-water system. The figures are based on a chips input of 1 ton solids per hour. The chips are fed to belt conveyor 1 with a dry content of 53%, having been dewatered to this consistency, for example, by conventional mechanical compression, and are discharged into the steaming vessel 2, where the chips are pre-steamed by means of atmospheric steam released as the defibered pulp is discharged after the defibering stage and supplied to the steaming vessel via pipeline 3. The hot chips are conveyed by the screw conveyor 4 to the screw feeder 5, which dewaters the chips by mechanical compression to 58% dry content as they are fed into the preheater 6 of the defibering stage. The compression extracts 275 kg water (moisture from the wood plus condensed steam), which drains off via pipeline 7. In the preheater 6 the chips are heated to 170° C. by the supply of approx. 200 kg of high-pressure steam from pipeline 8, whereafter the chips are introduced between the rotating grinding elements and by the supply of 175 kWh of electrical energy per ton of pulp are defibered to base pulp, which is used in the fiberboard either as it is or after limited refining. The pulp is discharged from the defibrator via line 10 to the cyclone 11, from which 400 kg of steam of 100° C. is drawn off by the fan 12, whereof 225 kg is piped to the steaming vessel 2 and 175 kg to the white-water preheater 13, in which a suitable amount of white water is heated to 80°–90° C. and fed to the tower 14, where the white water is cooled by counter-current air with consequent evaporation of water. The air is supplied by the fan 15. The pulp deposited in the cyclone 11 has a consistency of approx. 65% and is split up so that 906 kg dry weight of pulp is fed by the screw conveyor 20 to the bin 21, where the pulp is diluted with white water to a consistency suitable for forming of wet sheets, and 94 kg dry weight is fed by the screw conveyor 22 to the refiner 23, being diluted with 327 kg water added via pipeline 24. Of the water added, 275 kg consists of the water extracted and, screened off through the pipeline 7.

Therefore, only 52 kg of water has to be added. When the wet sheets are to be used for making insulation fiberboard, they should be diluted so as to form a wet sheet having a consistency between 40% and 55%, as indicated in our U.S. Pat. No. 4,012,279. When used for making hard board, the wet sheets should have a consistency of 50% to 55%, as indicated in our U.S. Pat. No. RE 29,770. The surface stock thus prepared is carried down into bin 25 and is further diluted via pipeline 26 with water exhausted during the forming of the layer of surface stock in the forming means 29 and collected via pipeline 28 in tank 27 to be transported by the pump 40 via pipeline 26 to the bin 25. Via the pump 41 and the pipeline 42 the surface stock suspension is transported to the forming means 29. In this way the surface stock is prepared and applied in a separate system, and the water recirculating from the forming of the surface stock will stabilize with a low concentration, between 1% and 1.5%, of soluble substances. The base stock suspension is transported by the pump 50 via pipeline 51 from the bin 21 to the forming machine 52 and a surface layer having a dry content 20% is applied to the forming layer of base pulp by the forming means 29. White water leaving the forming machine 52 is collected in bin 53, whence part of it is pumped by the pump 54 via pipeline 55 to bin 21 to be used for diluting base stock, and part through pipeline 56 to the preheater 13, in which the white water is heated to between 80° C. and 90° C. by means of steam discharged under pressure from the difibrator 9 and which, via the fan 12, is fed to the preheater 13 before being fed into the tower 14, there to be cooled by countercurrent air to the prevailing temperature in the white-water system, between 50° C. and 60° C., in the course of which cooling process water is evaporated. The cooled white water is drained via pipeline 57 to the bin 21.

Wet sheets produced in the forming machine 52 are conveyed on the belt conveyor 30 in the hot press 31. The white water extracted in the latter is collected in the tank 32 and recirculated to the bin 53 by the pump 33 and the pipeline 34. A lesser quantity of preheated white water may be fed to the defibrator 9 from the bin 53 via the pump 35, pipeline 36 and preheater 37 if the pulp consistency in the defibrator should become abnormally high for any reson, e.g. if the chips entering the defibrator have very high dry content.

Water may naturally also be driven off from the white water by vacuum evaporation at a temperature matching that of the white water, e.g. between 50° C. and 70° C.

If so much white water is extracted in the hot press from wet sheets formed in the above example as to raise the dry content of the sheets to 55%, a total of 296 kg water may be added to the white-water system without upsetting the white-water balance, if the pulp in the cyclone has a consistency of $\simeq$ 65%. As the surface stock has been diluted with 327 kg water, of which 75 kg remains in the board after pressing, there is no surplus water to be evaporated; instead, if necessary, an extra 125 kg water may be fed into the white-water system, or more water may be added during the refining of the surface stock and the surface layer applied with a slightly lower consistency.

To sum up, it may be said that in the case where the pulp web is to be coated with a surface layer of $\simeq$ 300 g stock per $m^2$ in the manufacture of hard fiberboard using a closed white-water system, without any extra energy being supplied in the form of steam or electrical power, the base pulp must be processed as far as is possible in the defibration stage, so that subsequent refining is unnecessary or can be effected with the minimum of energy consumption. If this is done, at least 150–175 kWh/tonne pulp may be supplied to the defibering stage and still the total power consumption for the preparation of the pulp not be greater than normal. The pulp discharged from the defibering stage must have a consistency of more than 60% and the input chips to steaming a consistency of at least 50%, and the chips after steaming and before being fed to the defibering stage must be dewatered at least to a consistency of 55%. At the same time, the consistency of the surface stock should be at least 10%, depending on the amount of steam available, to ensure a constant volume in the white-water system.

In the manufacture of such products as porous fiberboard that have a considerably lower dry content before the final drying, either the surface layer may be applied at a lower consistency or one or more of the above consistencies reduced.

We claim:

1. In the wet method of making fiberboard products from hot pressed wet sheets comprising at least one layer of surface pulp superposed on a layer of base pulp in a substantially closed and balanced white water system of predetermined volume, in which pulp is produced by treating moisture-containing chips of lignocellulosic material in a defibrator under generation of steam of predetermined superatmospheric pressure and correspondingly elevated temperature, the steam-entrained pulp being passed to a cyclone where the steam is separated from the pulp and utilized to presteam the chips to a predetermined temperature and moisture content, the pulp thus produced being suspended in white water to form a base layer pulp suspension which is transported to the base layer forming machine, where the white water is drained off from the suspension and recycled as dilution water to the base layer suspension stage, the improvement in said method for maintaining the volume of white water constant, comprising:

(a) dewatering the chips to a dry content of over 45% prior to being presteamed;

(b) presteaming the chips (c) further dewatering the presteamed chips and then defibrating them in the defibrator so that the consistency of the pulp entering the cyclone is in the range of 55%–70%;

(d) preparing a surface layer pulp suspension having a consistency of 10%–25%;

(e) transporting said surface layer suspension to a surface layer forming machine;

(f) withdrawing white water from said surface layer suspension to form a surface layer wet sheet and recycling said white water to the surface layer suspension stage to prepare a new surface layer suspension;

(g) applying said surface layer wet sheet to the base layer wet sheet at the base layer forming machine and simultaneously dewatering said surface layer and said base layer to form a layered sheet having a consistency of about 55% prior to hot pressing, wherein the white water from the dewatering of the base layer and surface layer on the baselayer forming machine is collected;

(h) operating the defibrator at an energy input to generate sufficient steam from the defibration of the chips to supply the steam demand for the presteaming of the chips as well as the steam necessary for use as heat to evaporate a sufficient portion of the white water collected in step (g) to maintain a constant white water level.

2. Method according to claim 1, in which water removed from the chips prior to the defibration step is added to the dilution water in preparing the surface layer suspension.

3. Method according to claim 1, in which the chips are defibrated at a temperature ranging between 110° C. and 200° C. and at a correspondingly superatmospheric pressure.

4. Method according to claims 1, 2 or 3 in which a portion of the white water drained from the base layer forming machine is passed to the defibrator.

5. Method according to claims 1, 2, or 3, in which a portion of the white water recycled to the base layer forming machine is passed in heat exchange relationship with a portion of separated steam from the cyclone.

* * * * *